US007128170B1

(12) United States Patent
Russell et al.

(10) Patent No.: US 7,128,170 B1
(45) Date of Patent: Oct. 31, 2006

(54) ADJUSTABLE STABILISER FOR DIRECTIONAL DRILLING

(76) Inventors: Mark Alexander Russell, Thorn House, Bradfield, Sheffield S6 6LB (GB); Andrew Ollerenshaw, 13 Dunkerley Road, Loxley, Sheffield, S6 6RB (GB)

( * ) Notice: Subject to any disclaimer, the term of this patent is extended or adjusted under 35 U.S.C. 154(b) by 0 days.

(21) Appl. No.: 10/441,672

(22) Filed: May 20, 2003

(51) Int. Cl.
*E21B 7/06* (2006.01)

(52) U.S. Cl. ..... 175/76; 175/325.5

(58) Field of Classification Search ..... 175/73, 175/76, 325.2, 325.5, 325.6
See application file for complete search history.

(56) References Cited

U.S. PATENT DOCUMENTS

| | | | | |
|---|---|---|---|---|
| 3,974,886 | A | 8/1976 | Blake et al. | |
| 3,986,554 | A | 10/1976 | Nutter | |
| 4,407,377 | A | 10/1983 | Russell | |
| 4,951,760 | A | 8/1990 | Cendre et al. | |
| 5,310,012 | A | 5/1994 | Cendre et al. | |
| 5,318,138 | A | 6/1994 | Dewey et al. | |
| 5,392,867 | A | 2/1995 | du Chaffaut et al. | |
| 5,452,772 | A | 9/1995 | Van Den Bergh | |
| 5,483,987 | A | 1/1996 | Amaudric du Chaffaut | |
| 5,511,627 | A * | 4/1996 | Anderson | 175/73 |
| 5,718,288 | A | 2/1998 | Bertet et al. | |
| 6,041,874 | A | 3/2000 | Lee | |
| 6,213,226 | B1 | 4/2001 | Eppink et al. | |
| 6,289,999 | B1 | 9/2001 | Dewey et al. | |
| 6,328,119 | B1 * | 12/2001 | Gillis et al. | 175/325.1 |
| 6,595,303 | B1 * | 7/2003 | Noe et al. | 175/74 |
| 6,708,785 | B1 * | 3/2004 | Russell et al. | 175/321 |
| 2002/0053470 | A1 * | 5/2002 | Noe et al. | 175/62 |
| 2004/0168832 | A1 * | 9/2004 | Russell et al. | 175/321 |

FOREIGN PATENT DOCUMENTS

| | | |
|---|---|---|
| EP | 0251543 A | 1/1988 |
| EP | 0409446 A1 | 1/1991 |
| EP | 0994236 A2 | 10/1999 |
| GB | 2258875 A | 2/1993 |
| GB | 2336171 A | 10/1999 |
| GB | 2342935 A | 4/2000 |
| GB | 2347443 A | 9/2000 |
| GB | 2385344 | 8/2003 |

* cited by examiner

*Primary Examiner*—William Neuder
(74) *Attorney, Agent, or Firm*—Kenneth A. Keeling; Keeling Patents & Trademarks

(57) ABSTRACT

A stabiliser (10) has a body (12) having a through-bore (16). A mandrel (14), also having a through-bore (20), is axially slidable in the body bore to actuate and de-actuate the tool. A step (64) in the body defines annular chambers (102, 104) between the mandrel and body on either side of the step. A control piston (18) in the mandrel alternately directs drilling mud pumped under pressure along said body bore and mandrel bore to the chambers to drive the mandrel hydraulically to actuate and de-actuate the tool.

The control piston has a through-bore (46) and is slidable in the mandrel bore against the force of a return spring (40) by drilling mud pressure from a low-pressure position to a pressure position. The pressure position is alternately one of an actuate position (a) and a de-actuate position (b), axially spaced along the mandrel bore from said actuate position.

28 Claims, 8 Drawing Sheets

ADJUSTABLE STABILISER FOR DIRECTIONAL DRILLING

CROSS-REFERENCE TO RELATED APPLICATIONS

This application claims the benefit of International Application number PCT/GB01/05057, filed on Nov. 15, 2001, which claims the benefit of foreign application GB 0028243.4, filed in Great Britain on Nov. 20, 2000.

STATEMENT REGARDING FEDERALLY SPONSORED RESEARCH OR DEVELOPMENT

Not Applicable.

BACKGROUND OF THE INVENTION

1. Field of the Invention

The present invention relates to down-hole tools and particularly to stabilisers for drill strings, especially near-bit stabilisers.

2. Description of the Related Art

Directional drilling is either sophisticated, expensive and unreliable or simple, reliable but rather limited. For the most part, the latter type meets all requirements. This type relies entirely on gravity and can only adjust the inclination of a hole, rather than its horizontal direction.

An adjustable stabiliser has a base diameter larger than the drill string, but not as large as the hole bore being drilled. It prevents the drill string from contacting the sides of the bore. When actuated however, its diameter increases and so the drill string is constrained to run concentric with the hole being drilled. Thus an adjustable stabiliser near the drill bit steers the drill bit depending on its actuation.

Down-hole motors are frequently used in drilling. The string itself is not rotated. Instead, the motor near the end of the string rotates just the bit at the end. The motor is hydraulically driven by drilling mud pumped from the surface. The down-hole motor should be as close to the drill bit as possible, but a stabiliser can be interposed between them in order to provide steerage.

Thus a short stabiliser is called for. Down-hole stabilisers have been actuated in a number of different ways.

In EP-A-0251543, a fairly short stabiliser is disclosed, but it involves using mechanical compressive forces on the drill string to set and unset it.

In U.S. Pat. No. 4,951,760, a stabiliser is hydraulically operated, employing fluid pressure of pressurised drilling mud to actuate the stabiliser by a piston mandrel moving axially in a bore of the body of the stabiliser and having ramps or cams which move a stabiliser bar radially outward. A long, and strong, spring returns the stabiliser to a deactivated position when the fluid pressure is released.

In the same patent a throttle member increases the pressure drop across the tool, serving both to accelerate movement of the mandrel for actuation of the tool and to signal to the surface the state of actuation of the tool.

BRIEF SUMMARY OF THE INVENTION

It is an object, at least in one aspect of the present invention, to provide a down-hole tool which is relatively short and does not suffer the disadvantages of the prior art, or at least mitigates their effects.

In another aspect, it is an object of the present invention to provide a down hole tool which minimises mechanical contact between components in order to reduce opportunity for jamming, as well as wear.

In accordance with the present invention there is provided a down-hole tool comprising:

a body having a through-bore;

a mandrel, being axially slidable in the body bore to actuate and de-actuate the tool; and a valve to control hydraulically the movement of the mandrel by drilling mud pumped under pressure along said body bore.

Preferably said valve controls the drilling mud to drive the mandrel hydraulically both to actuate and de-actuate the tool. Thus, by hydraulically driving the mandrel in both directions, the need for a strong return spring is avoided.

Preferably, the mandrel has a through bore and the valve comprises a control piston slidable in the mandrel bore, against the force of a return spring, by drilling mud pressure from a low-pressure position to a pressure position.

Said pressure position may alternately be one of an actuate position and a de-actuate position axially spaced along the mandrel bore from said actuate position, the tool being actuated by mud pressure when the piston is in said actuate position and de-actuated when in said de-actuate position. The actuate position may be between the de-actuate and low-pressure positions of the piston.

A return step is preferably formed in the body and mandrel to define annular chambers between them on either side of the return step, one chamber, when pressurised with mud, serving to actuate the tool while the other serves to de-actuate the tool.

Said control piston may have an axially disposed passage and a seal against the mandrel at both ends of the passage, the mandrel having two ports communicating each of said annular chambers with the mandrel bore and an intermediate port venting said passage, the piston in the actuate position connecting one chamber with the passage and the other chamber with the piston bore beyond the seals, and vice-versa in said de-actuate position.

Preferably, the mandrel bore and piston are stepped, the annular piston chamber formed by said step between them being vented so that pressure of drilling mud in the body moves the piston along the mandrel to close said piston chamber.

The piston and mandrel between them preferably define a barrel cam so that the piston rotates on axial movement thereof relative to the mandrel, the cam permitting different strokes of the piston in dependence upon the angular position of the piston in the mandrel.

The piston and mandrel may have inter-digitating castellations which, when they oppose one another in a first angular position of the piston with respect to the mandrel, as determined by the barrel cam, permit the piston to move to one of said actuate and de-actuate positions and, when they inter-digitate, permit the piston to move to the other of said actuate and de-actuate positions.

The barrel cam may comprise a pin in a track and the track is arranged so that rotation of the piston with respect to the mandrel is complete before the castellations engage one another. The track may be on the piston and the pin on the mandrel.

The track is preferably so arranged that the castellations abut in either the actuate or de-actuate positions and transmit axial hydraulic forces between the piston and mandrel before the pin reaches the end of the track.

Preferably, the return step is inward of the body and comprises two rings interconnected and captivating between them ring sectors received in an annular groove in the body.

A passage through the return step may be vented and communicate with said intermediate port of the mandrel, the mandrel being sealed to the return step on either side of said passage and intermediate port.

The diameter of the chambers are preferably different, the chamber serving to actuate the tool when pressurised having the larger diameter.

Additionally, or alternatively, the diameter of the mandrel in the body on the sides of the chambers remote from the return step is larger on the side where hydraulic pressure moves the mandrel to actuate the tool.

Both these differences serve to increase the force with which the tool is actuated which, in the case of a stabiliser, may be necessary if the drill string is not already central in the hole being drilled.

A choke may be activated when the tool is actuated, such activation to change the pressure drop of the drilling mud across the tool so as to signal the states of actuation of the tool. The piston may carry a piston restrictor plate across the piston bore in face to face contact with a mandrel restrictor plate, the restrictor plates being angularly fixed with respect to the piston and mandrel respectively and restricting mud flow through the tool in dependence upon their relative angular position.

Preferably, the mandrel restrictor plate is angularly fixed with respect to the body, the body being angularly fixed with respect of the mandrel.

Preferably, the restrictor plates have a central aperture in register with one another and alternating sector spaces and sector lobes so that, when the lobes on the piston and mandrel plates are in register with one another, mud flows through both the central aperture and spaces, and when the lobes and spaces are in register, mud flows through the central aperture.

In a different aspect of the present invention, said mandrel is moved to actuate the tool by hydraulic pressure of said drilling mud when said valve permits bleeding of a bleed chamber. Preferably, in this event, the mandrel is moved to de-actuate the tool, on release of said hydraulic pressure, by a mandrel return spring.

Said bleed chamber may be formed by a step between the mandrel and body.

Said piston may serve to open and close a port between said bleed chamber and the body bore. Preferably, said piston, when it moves from said low-pressure position to said pressure position, only opens said port when it moves to said actuate position.

Preferably, said body defines, with the ends of said piston and mandrel, a valve chamber, said choke comprising a path between said piston and body which is opened when said piston moves to said actuate position and the mandrel moves to actuate the tool, and which is restricted when the piston moves to said de-actuate position.

In one application of the present invention, the tool is a stabiliser and comprises members radially disposed in the body and pressed outwardly during actuation of the tool to increase the effective diameter of the stabiliser.

Indeed, the invention provides a drill string comprising a drill bit and a near-bit stabiliser as defined above.

BRIEF DESCRIPTION OF THE DRAWINGS

The invention is further described hereinafter, by way of example, with reference to the attached drawings, in which.

DESCRIPTION OF THE INVENTION

Figure 1A:
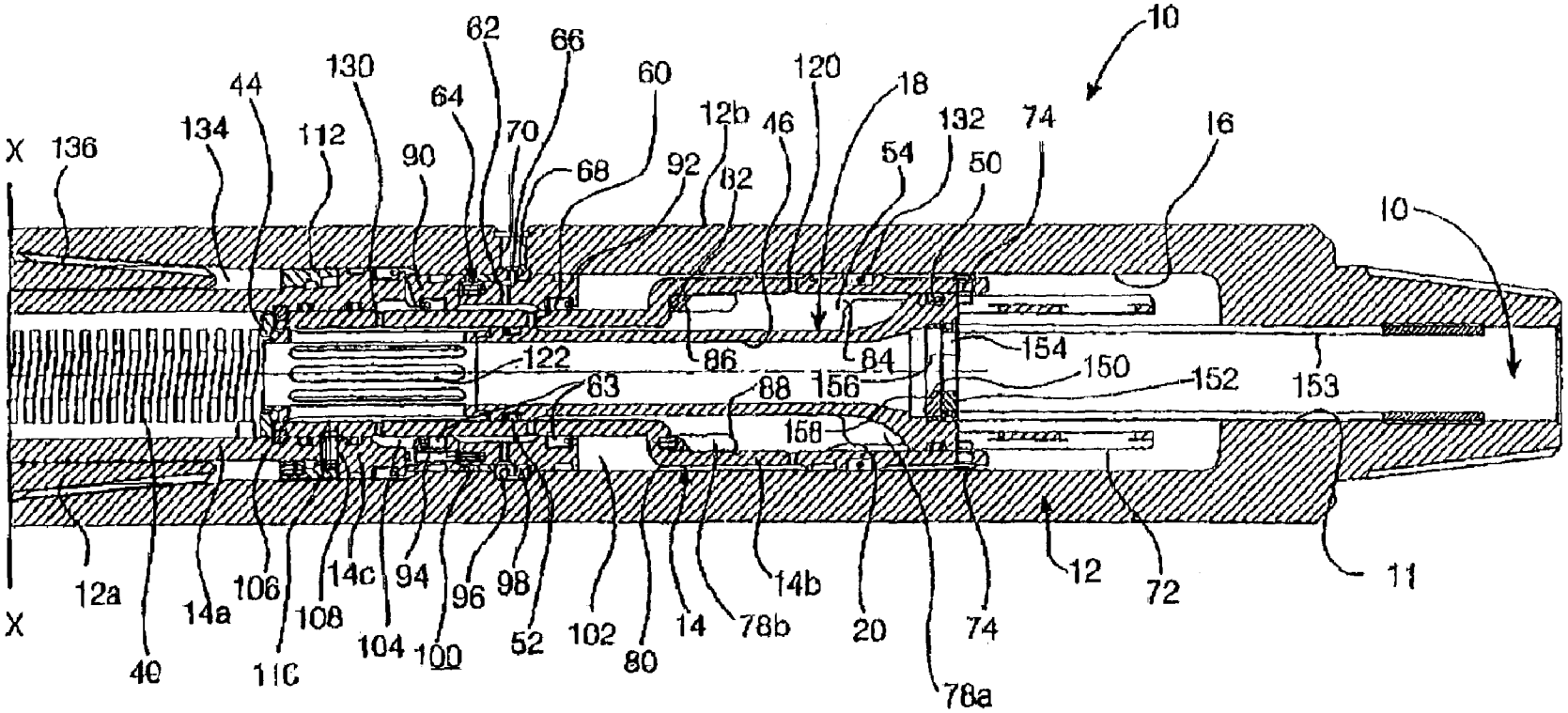
FIGS. 1*a* and 1*b* are a longitudinal section when joined end to end along lines X—X in each drawing through a stabiliser in accordance with the present invention.
Figure 1B:
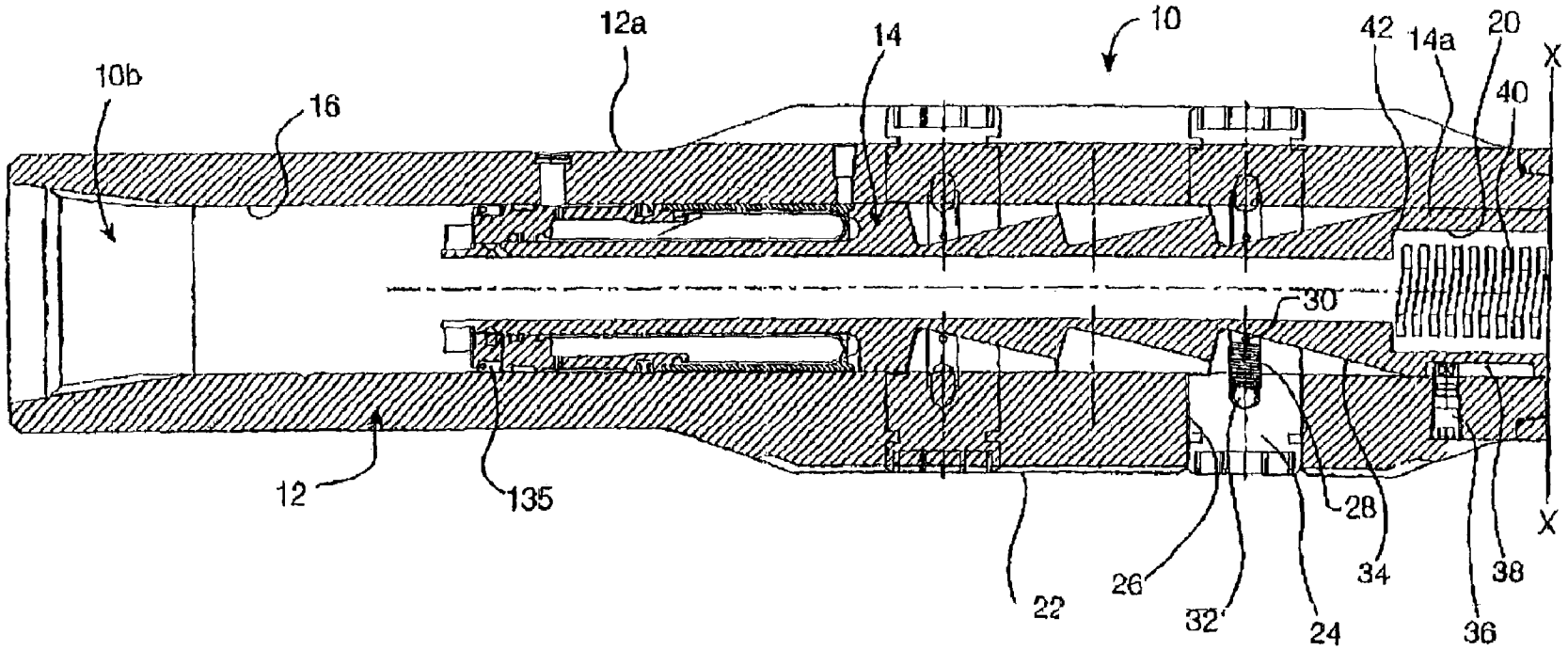

Referring to FIGS. 1*a* and 1*b*, a drill string stabiliser 10 comprises a body 12 in two parts 12*a*, 12*b*. A mandrel 14 is slidable in bore 16 of the body 12. The mandrel likewise comprises two parts 14*a*, 14*b*. A control piston 18 is slidable in a bore 20 of the mandrel 14.

The body 12 has enlarged stabiliser bars 22 comprising spirally formed bars in which pistons 24 are disposed in radially directed bores 26 through the wall of the body 12. Springs 28 acting on cross pins 30 (fixed in the pistons 24) and studs 32 (fixed in the stabiliser bars 22), press the piston 24 radially inwardly against wedge surfaces 34 formed on the mandrel 14. When the mandrel 14 moves leftwardly in FIG. 1, the pistons 24 are pressed radially outwardly to increase the effective diameter of the stabiliser 10. The angular position of the mandrel 14 is fixed by a pin 36 in the body 12 engaging a slot 38 in the side of the mandrel 14.

A return spring 40 is disposed in the bore 20 of the mandrel 14 and bears on a shoulder 42 of the mandrel at one end and, through a thrust-bearing 44, on the piston 18.

The piston 18 has its own through-bore 46 so that a clear passage extends from an upstream end 10*a* to a downstream end 10*b* of the tool 10. The piston 18 is sealed to the bore 20 of the mandrel 14 through ring seals 50, 52 which, it will be noted, are of different diameters. Consequently, since piston chamber 54 is vented (as explained further below), any increase in hydraulic pressure in the bore 46 will result in leftward movement of the piston as shown in FIG. 1.

Piston chamber 54 communicates with intermediate port 60 of mandrel 14, which in turn communicates with passage 62 in step ring 64, and then with aperture 66 in ring sectors 68 and finally vent port 70 in the wall of the body 12.

Thus, as is well known in the art, drilling mud pumped under pressure down the drill string and through the stabiliser 10. It returns under reduced pressure around the outside of the drill string and stabiliser 10. Consequently, when the drill string is pressurised with drilling mud the piston 18 moves leftwardly in the drawing compressing the spring 40. A barrel cam 72 is formed on one end of the piston 18, the mandrel 14 being provided with pins 74 whose ends engage the barrel cam 72.

Figure 6A:
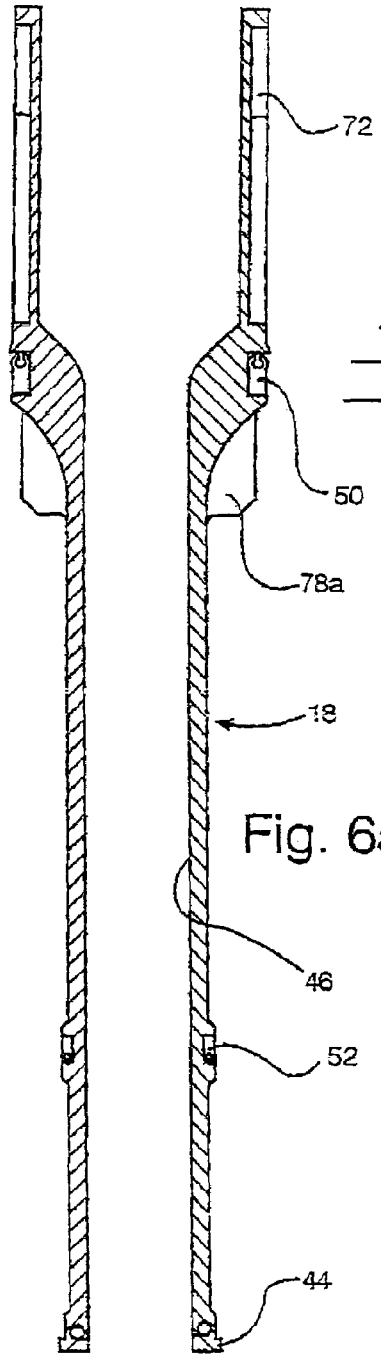
FIG. 6*a* is a side profile of the barrel cam track employed on a control piston in accordance with the present invention, FIG. 6*b* comprising an enlarged section through the control piston.
Figure 6B:
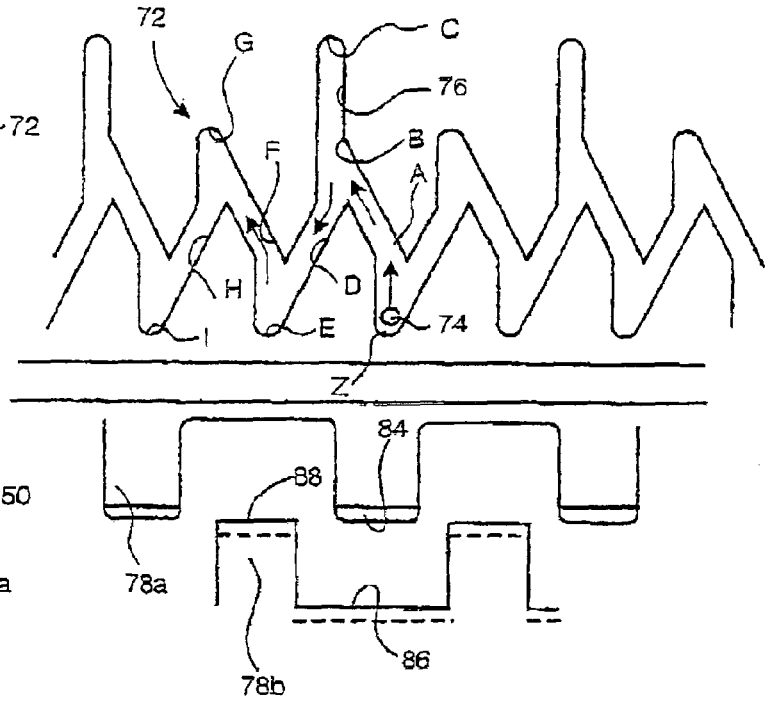

Turning to FIGS. 6*a* and 6*b*, the barrel cam 72 is shown having a cam track 76. The arrows in the drawing show the movement of the pins 74 as the piston moves backwards and forwards in the axial direction. If the pin 74 starts in the position Z as shown in FIG. 6*b*, then as the barrel cam moves downwardly in the drawing, the pin will impact the side of track 76 at point A, whereupon further axial movement of the piston will result in rotation of the piston until point B is reached. The piston can continue axial movement until the pin reaches point C. When the mud pressure is reduced, the spring 40 returns the piston, which moves axially until the pin 74 impacts the wall of the track 76 at D, whereupon the piston rotates in the same direction as when moving from A to B until it reaches point E. The next time the mud pressure is increased again, the piston will move axially until the pin 74 strikes the wall 76 of the track at point F, where again the piston will be turned to rotate in the same direction and until the pin reaches point G. On the next cycle, when the mud pressure is again reduced, the pin strikes the track 76 at H before turning the piston once more until the pin 74 reaches point I which is equivalent to the start position.

The piston 18 is provided with castellations 78*a* on an external surface thereof and which castellations match internal castellations 78*b* in the mandrel 14. Indeed, the castellations 78*b* may be provided on a separate element 80 bolted to the base of a step 82 in the mandrel 14, which step 82, in fact, defines the piston chamber 54.

The track 72 is so arranged in relation to the castellations 78*a* on the piston 18, and the castellations 78*b* in the mandrel 18 are so arranged in relation to the pins 74, that, when the pin reaches position B in the track 76, the castellations 78*a*, 78*b* inter-digitate, as shown in FIG. 6*b*. This means that the piston can move down the bore 20 of the mandrel until chamfered edge 84 of the castellations 78*a* contact and abut chamfered base 86 of the castellations element 80. Indeed, the track 76 is so arranged that contact between the castellations occurs before the pin contacts the end of the track 76 at C, so that, when further load is imposed between the piston 18 and mandrel 14, it is transmitted through the more substantial abutments between castellation surfaces 84, 86 than through the pin 74 and track 76. On the other hand, when the pin is in position G, the castellations 78*a*, 78*b* face one another, so that the piston can only advance until chamfered edge 84 abuts chamfered face 88 of the castellations 78*b*. Likewise, the castellations 78*a*, 78*b* abut one another before the pin 76 impacts the base of the track 76 at G.

There are preferably three castellations 78*a*, 78*b* around the circumference of the piston and mandrel respectively, and likewise three repetitions of the cycle Z to I described above, so that a complete cycle represents a rotation of the piston in the mandrel of 120°, and a difference between inter-digitation and mutual opposition of the castellations 78*a*, 78*b* of 60°.

The internal return step 64 of the body 12 is provided in the bore 16 of the body 12 by two rings 90, 92 bolted together by evenly spaced bolts 94 around the peripheries of the rings 90, 92. An internal grove 96 is formed in the body 12 and three ring sectors 98, each of about 120° of arc, are captivated in the grove 96 by clamping together the step rings 90, 92. Shims 100 can be inserted on either side of the ring sectors 98 in order to adjust the axial position of the step 64 in the bore 16 of the body 12.

The step 82 in the mandrel 14 creates a first annular chamber 102. After assembly of the piston 18 in the mandrel part 14*b* and insertion thereof in the bore 16, and after fixing of the step rings 64 in the bore 16, the second part 14*a* of the mandrel is connected to the first part 14*b*. This is effected by ring sectors 106 and pins 108 retained in engagement with inset holes 110 in the surface of the mandrel 14 by ring 112 retained on flange 14*c* of the mandrel part 14*a* by means not shown.

Mandrel part 14*a* defines with the step 64 a second annular chamber 104. The step 82 is a return step because the chambers 102, 104 oppose one another.

The mandrel 14 is provided with a first port 120 which communicates the bore 20 of the mandrel with the first annular chamber 102. The mandrel 14 has a second port 130 which communicates the second annular chamber 104 with the bore 20 of the mandrel.

However, with respect to the first chamber 102, the port 120 opens into the piston annular chamber 54 between the seals 50, 52 on the piston 18. Therefore, chamber 102 is isolated from the bore 46 of the piston 18 and the pressure of the drilling mud therein. In fact, by virtue of intermediate port 60 in the mandrel 14, which is vented to the outside through passages 62, 66, 70, (and isolated by seals 63) the annular chamber 102 is likewise vented to the outside. On the other hand, chamber 104 is in communication with the drilling mud under pressure in bore 46 of the piston 18 by virtue of the second port 130 and a number of slots 122 in the piston 18.

Thus, from the position shown in FIG. 1*a*, when the pressure of the drilling mud increases, the pressure in chamber 104 rises and begins to urge the mandrel 14 leftwardly in the drawing. The mandrel 14 is sealed at both ends to the bore 16 of the body 12 by seals 132, 135. The diameter of the bore 16 in body part 12*b* is slightly greater than the diameter of the mandrel in body part 12*a*. Therefore, there is net leftward force on the mandrel 14 which moves in that direction since the annular space 134 formed by the step between the body parts 12*a*, 12*b* is vented by radial outward movement of the piston members 24. At the same time the piston 18 also moves leftwardly with respect to the mandrel, and if the piston is in such a position that the castellations 78*a*, 78*b* oppose one another and abut through chamfered faces 84, 88, this leftward movement of the mandrel persists. In that event, the inclined surfaces 34 of the mandrel 14 press the piston members 24 radially outwardly until ring 112 abuts the end of the body part 12*a*. Indeed, the final diameter of the stabiliser 10 when actuated is determined by the axial extent of permitted movement of the mandrel 14, and this can be controlled by shimming out the ring 112.

However, if the castellations 78*a*, 78*b* are in a de-actuate position in which they inter-digitate, then the piston 18 continues leftward movement, and in this event two hydraulic switches occur. The first is that the seal 50 passes the first port 120 so that instead of communicating the first annular chamber 102 with a vent through intermediate port 60, the annular chamber 102 is connected to mud pressure behind the piston 18. Secondly, the seal 52 at the other end of the piston passes the second port 130 in the mandrel 14, so that, instead of the second annular chamber 104 being connected to mud pressure inside the bore of the piston 18, that chamber is instead put in communication with the intermediate port 60 and, thereby, the vent 62, 66, 70 to outside. There is, therefore, a reversal of the hydraulic forces acting on the mandrel 14 and it moves to the position shown in FIG. 1*a* where the pistons 24 are fully retracted and the stabiliser 10 is de-actuated.

Figure 2A:
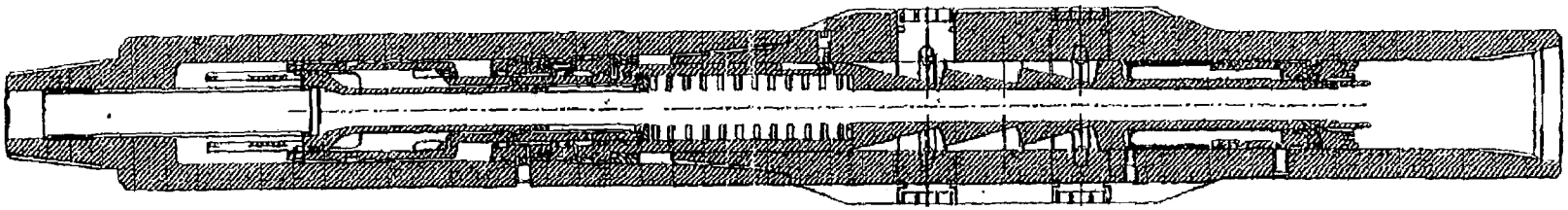
FIGS. 2*a* to 2*f* are longitudinal sections through the stabiliser of FIG. 1 in different states of actuation.
Figure 2B:
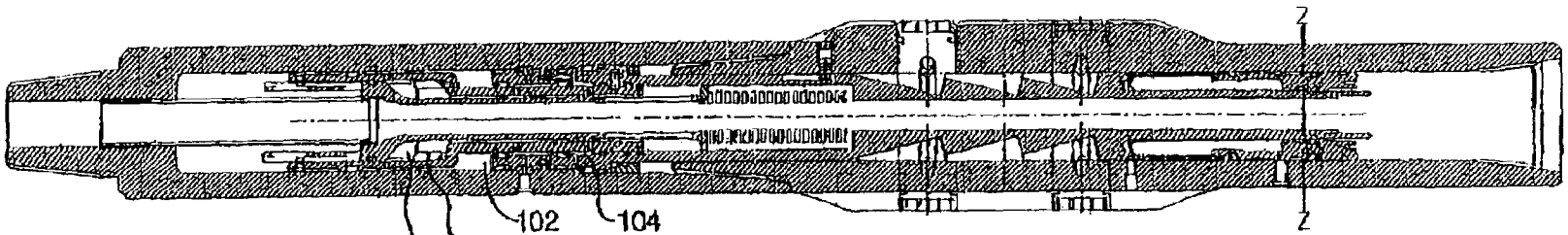
Figure 2C:
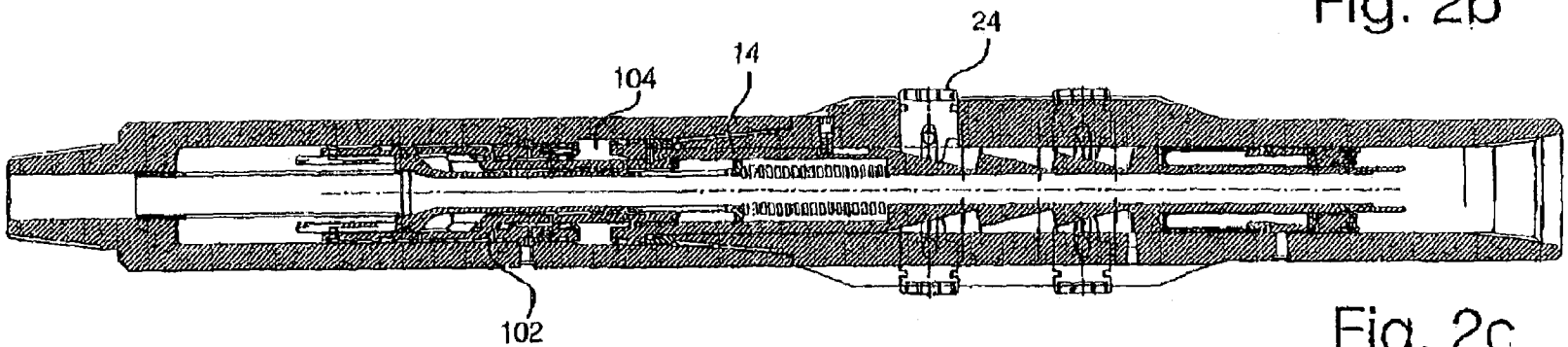
Figure 2D:
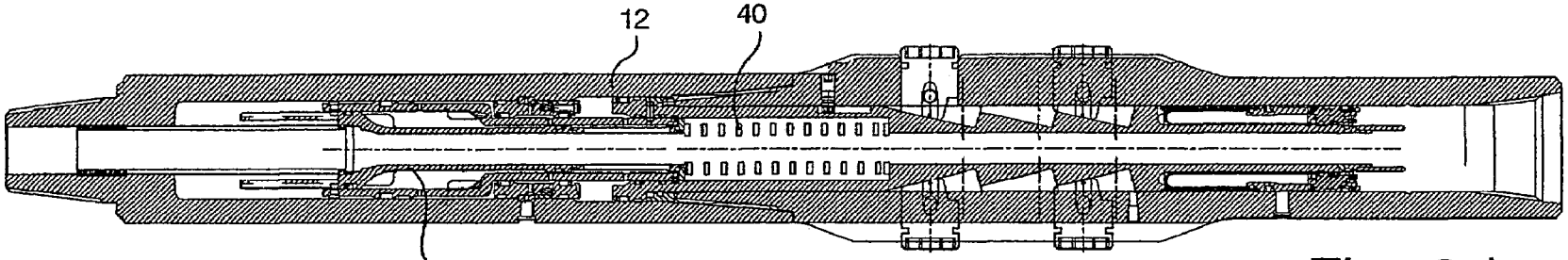

FIGS. 2*a* to 2*f* show the sequence of cycling. In FIG. 2*a* the position is as shown in FIGS. 1*a* and 1*b*. In FIG. 2*b* fluid pressure has moved the piston rightwardly in the drawing until the castellations 78*a*, 78*b* abut one another. In this position, the first chamber 102 is vented while second chamber 104 is connected to higher pressure. Therefore, the mandrel 14 moves rightwardly in the drawing to the position shown in FIG. 2C. Here, second annular chamber 104 is fully developed and first annular chamber 102 is now closed. Moreover, the pistons 24 are now radially extended. In FIG. 2D fluid pressure in the drill string has been switched off so that spring 40 returns piston 18 to its position in the mandrel it has in FIG. 2*a*. However, because the spring 40 is acting between the piston and mandrel, the mandrel does not move in the body 12.

Figure 2E:
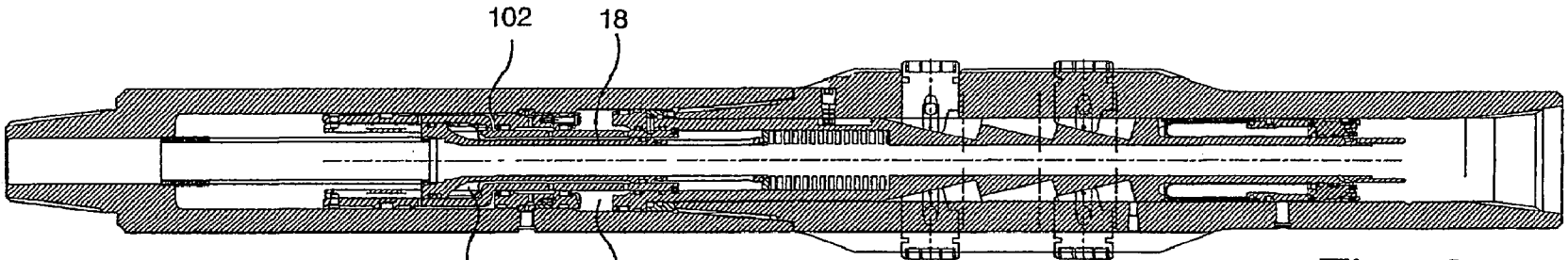
Figure 2F:
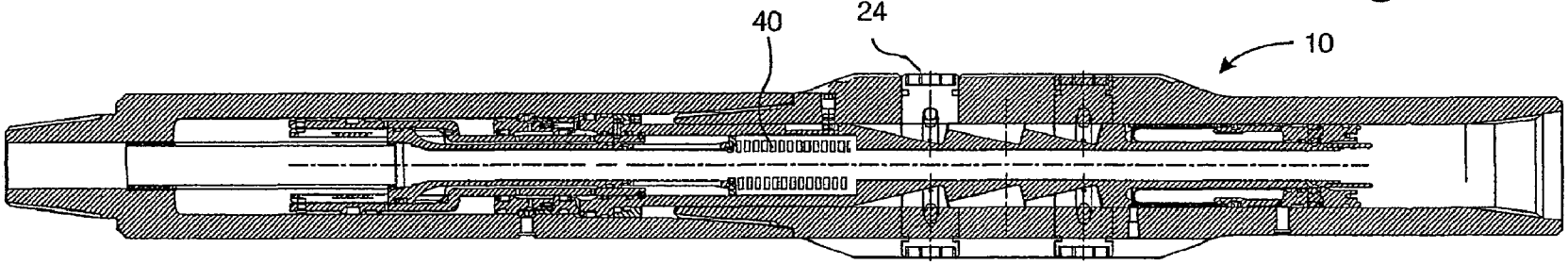

In FIG. 2*e*, fluid pressure in the drill string is once again reinstated and accordingly the piston 18 moves rightwardly in the drawing and this time the castellations 78*a*, 78*b* inter-digitate so that the piston 18 moves further rightwardly in the mandrel than it did in the previous half-cycle (as shown in FIG. 2C). There is therefore the reversal mentioned above in that the second annular chamber 104 is now vented and the first annular chamber 102 is connected to fluid pressure. In this event, the mandrel 18 moves leftwardly in the drawing to the position shown in FIG. 1 where the pistons 24 are fully withdrawn and the stabiliser 10 has a minimum diameter. The spring 40 is nevertheless fully compressed.

Figure 1C:
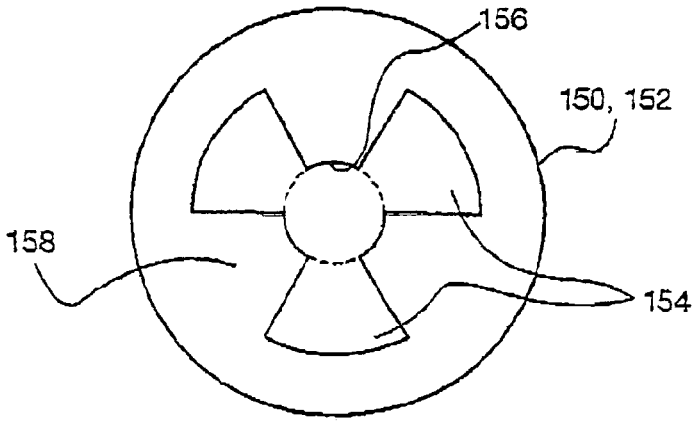
FIG. 1*c* is am end view of a restrictor plate.

Returning to FIG. 1A, a piston restrictor plate 150 is fitted in the mouth of the bore 46 of the piston 18. A sleeve 153 is a sliding fit, without rotation, in bore 11 of the body 12. In the end of the sleeve 153 facing the piston restrictor plate 150 is a mandrel restrictor plate 152. FIG. 1*c* is an end view of a restrictor plate which is circular but has three 60° open sectors 154. Both restrictor plates 150, 152 have identical profiles so that when they are perfectly aligned, a central bore 156 is open, as well as the 60° sectors 154. However, by rotating the piston through 60° with respect to the mandrel, and hence the body 12 and mandrel restrictor plate 152, open segments 154 of the restrictor plate coincide with closed segments 158 of the other restrictor plate 152. Consequently, in this arrangement, the only passage through the restrictor plates 150, 152 is the central opening 156. There is therefore a marked pressure difference across the restrictor plates which is detectable at the surface. Since an increased pressure difference increases the leftward forces on the piston 18, and hence on the mandrel 14, the restrictor plates 150, 152 are arranged so that they are out of phase with one another (ie when only the passage 156 exists through them) when the piston castellations 84 abut the tips of the mandrel castellations 88 and in which the mandrel is urged leftwardly to its actuated position.

Figure 3:
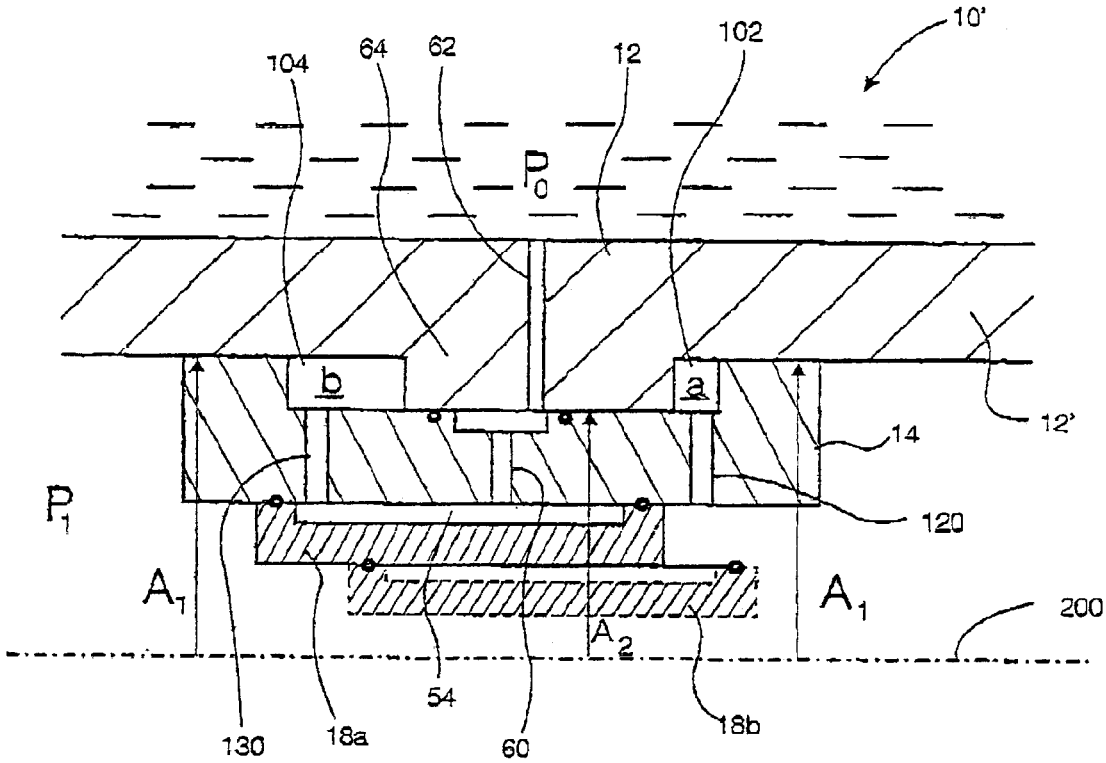
FIG. 3 is a schematic diagram of the tool actuating arrangement of a tool in accordance with the present invention.

FIG. 3 is a schematic representation showing the principle of operation of the tool shown in FIGS. 1 and 2. Phantom line 200 is the centre line of the down-hole tool 10'. Body 12 is provided with vent aperture 62 extending through return step 64. Mandrel 14 receives piston 18 and has first and second ports 120, 130. First and second annular chambers 102, 104 are here labelled a, b. Intermediate port 60 communicates vent port 62 with passage 54 between piston 18 and mandrel 14. The piston is shown in two axial position 18*a*, 18*b*. In position 18*a* annular chamber 104(*b*) is vented to atmosphere through second port 130, passage 54, intermediate port 60 and vent 62, while first annular chamber 102(*a*) is connected to main pump pressure ($P_1$) through first port 120.

In FIG. 3, the area of the mandrel 14 under the step 64 is $A_2$, which is dependent on the diameter of the step 64. Likewise, the areas $A_1$ of the mandrel under the chambers 102, 104 is determined by the diameter of those chambers. In FIG. 3, the chambers have the same diameter. Thus, the forces acting on the mandrel 14 when the piston 18 is in the position 18*a* is given by $$F_a=P_1(A_1-A_2)$$

On the other hand, when the piston is in position 18*b*, then the situation is reversed and it is second annular chamber 104(*b*) which is connected to high pressure, whereas first annular chamber 102 is vented. Thus, the force ($F_b$) acting on the mandrel 14 is given by $$F_b=-P_1(A_1-A_2)$$

Thus, the value of the force on the mandrel 14 is the same in both positions of the piston 18, except that it is reversed in direction.

Figure 4:
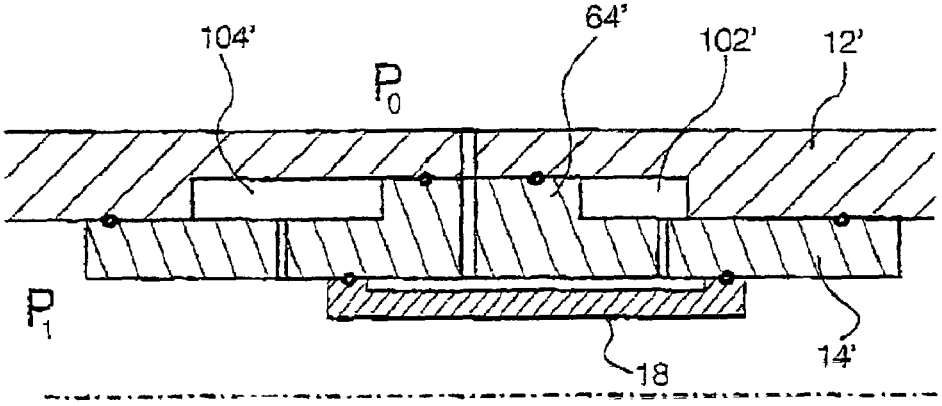
FIG. 4 is a schematic diagram of an alternative arrangement.

FIG. 4 shows an alternative arrangement in which the step 64' is formed as part of the mandrel 14' so that the chambers 102', 104' are in a recess of the body 12' rather than in a recess of the mandrel 14'. While this creates different issues of construction, the operation is in principle identical with that described above in relation to FIG. 3.

Figure 5:
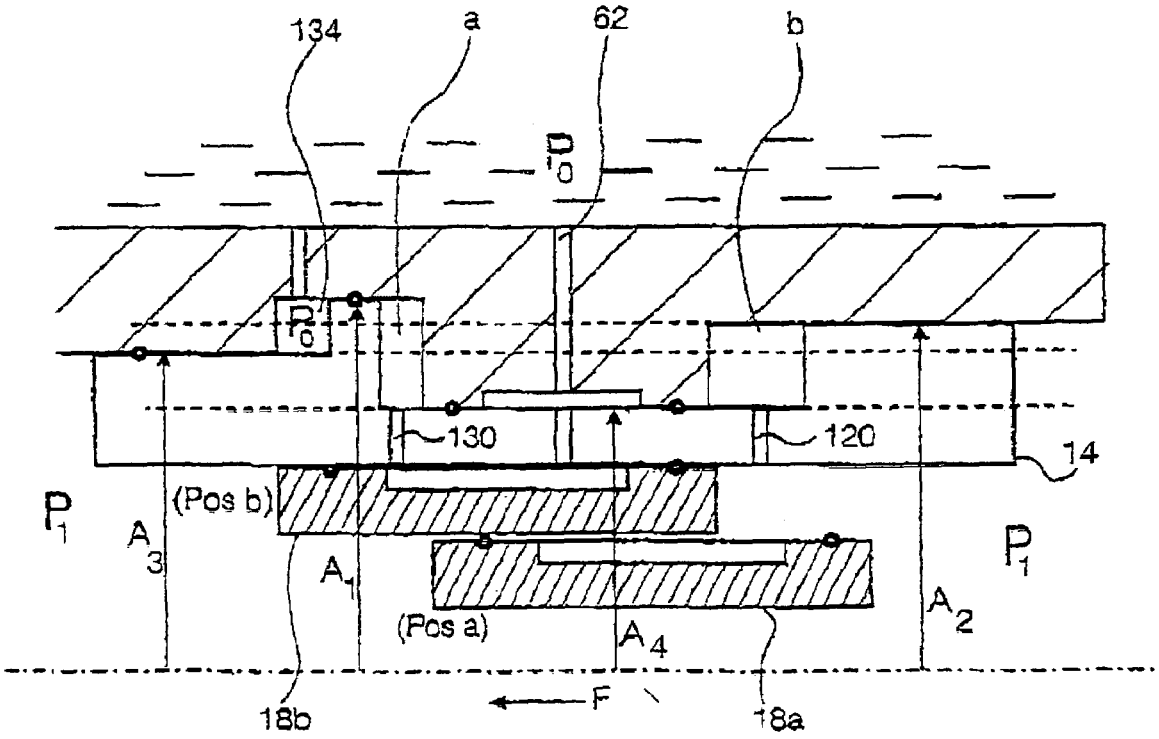
FIG. 5 is a schematic illustration similar to FIGS. 3 and 4 of a further preferred embodiment corresponding with the arrangement shown in FIGS. 1 and 2 above.

FIG. 5 illustrates a preferred arrangement in which the forces acting in the direction of actuation (arrow F in FIG. 5) is greater than in the reverse. In FIG. 5, $$F_a=P_1(A_1-A_3+A_2-A_4), \text{ whereas}$$

$$F_b=-P_1(A_3-A_4), \text{ where}$$

$F_a$ and $F_b$ are the forces acting in the direction of the arrow F when chambers a and b are respectively pressurised with mud pressure $P_1$. In this scenario $F_a$ is in the direction of the arrow F because ($A_1$+$A_2$) is greater than ($A_3$+$A_4$), whereas $F_b$ is in the opposition direction because $A_3$ is greater than $A_4$. However, the value of $F_a$ is much larger than the value of $F_b$, which is desirable because the potential force required to push the pistons radially outward is much larger than that potentially required to release them.

Figure 7:
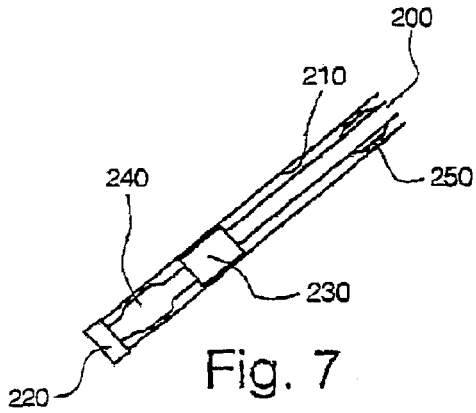
FIG. 7 is an illustration of a down-hole drill string.

FIG. 7 is a schematic diagram of a drill string 200 in a well bore 210, the drill string terminating in a drill bit 220 driven by a down-hole motor 230 which is spaced from the drill bit by a near-bit stabiliser 240. A remote stabiliser 250 is spaced some distance from the motor 230. If the stabiliser 240 is de-actuated, then the weight of the motor 230 and drill bit 220 tends to drop the drill string vertically so that the drill tends to vertical. On the other hand, if the stabiliser 240, is actuated, then the drill string tends to follow a straight line.

Figure 8A:
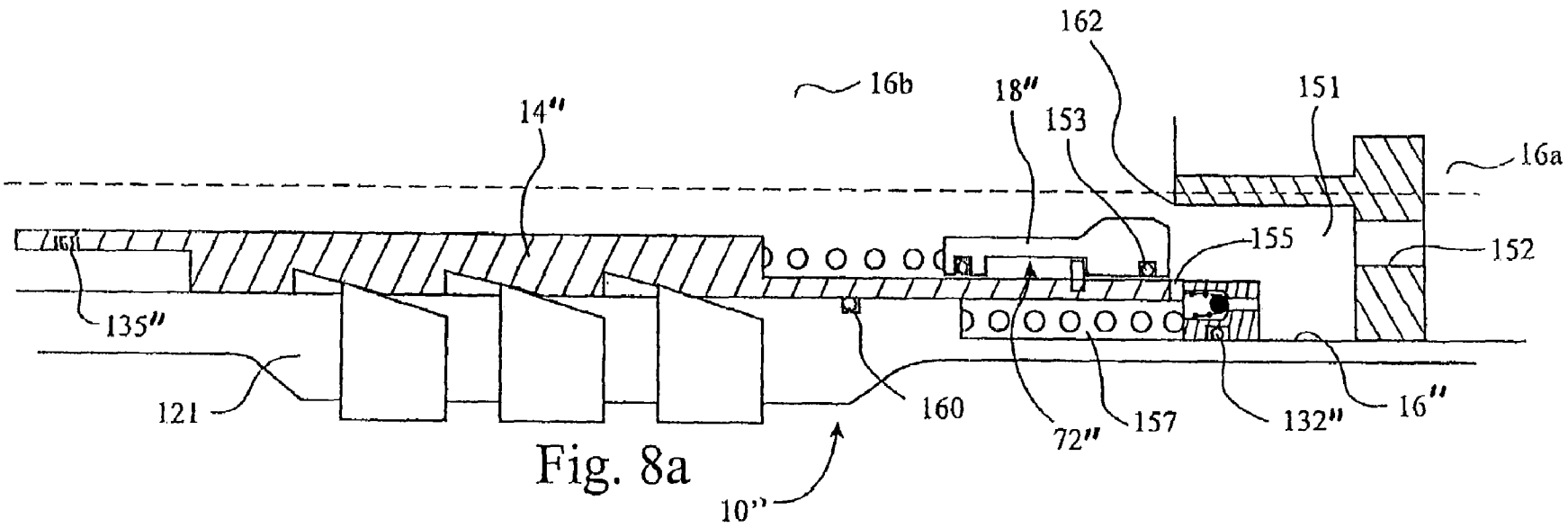
FIGS. 8 *a* and *b* are sections through an alternative arrangement of present invention.

Finally, FIGS. 8 *a, b* show an alternative arrangement, being a half longitudinal section through a tool 10'''. Here actuation of the tool 10''' is effected by movement of the mandrel 14''', which slides in a stepped body bore 16''' of the body 12'''.

Figure 8B:
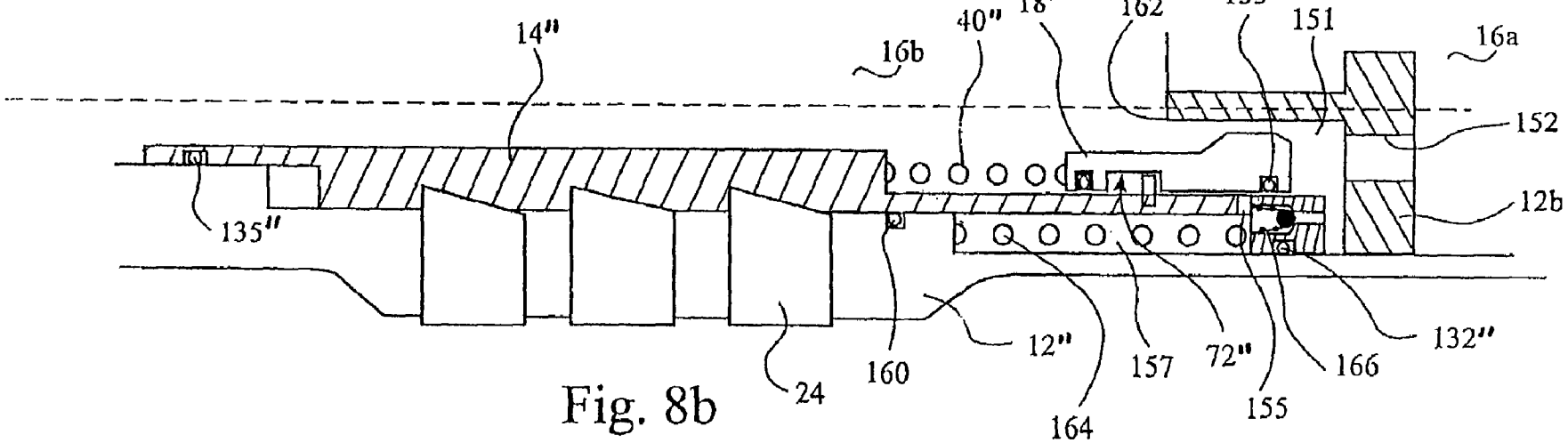

FIG. 8*b* shows a de-actuated position of the piston 18''' relative to the mandrel 14'''. The piston 18''' is positioned between a body cup 12*b* forming an annular valve chamber 151. One or several apertures 152 connect the body bore up-stream (16*a*) and down-stream (16*b*) of the body cup 12*b*. When hydraulic pressure of drilling mud in the bore 16*a* rises, piston 18''' is pressed leftwardly in the drawing against the force of return spring 40''' to the position shown in FIG. 8*b*. However, here, a sealing ring 153 has not passed over a bleed port 155 in the wall of the mandrel 14'''. Therefore a bleed chamber 157 cannot be vented, it being sealed at its ends by seal rings 132''' and 135''', and possibly intermediate seal ring 160.

Piston 18''' is prevented from moving further than shown in FIG. 8*b* by a barrel cam arrangement 72''' similar to that described above. When the hydraulic pressure is lowered sufficient to permit the return spring 40''' to urge the piston 18''' to its low pressure position (not shown) then it rotates, as described above. Thus, when the hydraulic pressure again rises, the piston moves on the mandrel 14''', under hydraulic action, to the position shown in FIG. 8*a*.

In this position, port 155 is exposed, so that hydraulic pressure urges the mandrel leftwardly in the drawing and pressurises bleed chamber 157. The fluid in it escapes into valve chamber 151 and permits the mandrel to move to the position in the body 12''' shown in FIG. 8*a*. Here, the piston members 24 are pressed outwardly.

Furthermore, the piston 18''' clears internal edge 162 of the body cup 12*b* so that the fluid flow passage formed between the two is substantially enlarged and so that the pressure drop across the arrangement is substantially reduced. Such reduction in pressure drop, and maintenance of a high pressure drop in the case of the de-actuated position in FIG. 8*b*, informs the user of the state of actuation of the tool 10'''.

Nevertheless, while mud pressure remains high, the pressure drop across throat 162 is sufficient to keep the piston in the position shown. However, when the pressure drops, the piston moves rightwardly in the drawings. The mandrel likewise moves rightwardly, driven by a mandrel return spring 164. However, it may be possible for the piston 18''' to cover the port 155 before the mandrel has moved all the way to the de-actuated position of FIG. 8*b*. Consequently a non-return valve 166 may be provided in the end of the mandrel 14''' to permit mud to enter the bleed chamber 157.

While this arrangement employs a mandrel return spring and is therefore necessarily longer than the previous embodiment, nevertheless it removes the necessity of employing mechanical detent means which must be shifted between the mandrel and body to permit and restrain the movement of the mandrel.

What is claimed is:

1. A down-hole tool comprising:

a body having a through-bore;

a mandrel having a through-bore and being axially slidable in the body bore to actuate and de-actuate the tool, the mandrel being slidable by hydraulic forces of drilling mud pumped under pressure along said body through-bore: and a valve to control access of said drilling mud to the mandrel, and thereby to control hydraulically the movement of the mandrel, wherein the valve has an actuate and a deactuate position, in the actuate position of which valve said drilling mud actuates the tool and in the deactuate position of which valve said drilling mud does not actuate the tool, and wherein the valve comprises a control piston slidable in the mandrel bore, against the force of a return spring by drilling mud pressure, from a low-pressure position to a high-pressure position.

2. A tool according to claim 1, wherein said valve controls the drilling mud to drive the mandrel hydraulically both to actuate and de-actuate the tool.

3. A tool according to claim 1, wherein said pressure position is alternately one of said actuate position and said de-actuate position axially spaced along the mandrel bore from said actuate position, the tool being actuated by mud pressure when the piston is in said actuate position and de-actuated when in said de-actuate position.

4. A tool according to claim 3, wherein the actuate position is between the de-actuate and low-pressure positions of the piston.

5. A tool according to claim 3, wherein said valve controls the drilling mud to drive the mandrel hydraulically both to actuate and de-actuate the tool and wherein a return step is formed in the body and mandrel to define annular chambers between them on either side of the return step, one chamber, when pressurized with mud, serving to actuate the tool while the other serves to de-actuate the tool.

6. A tool according to claim 5, wherein said control piston has an axially disposed passage and a seal against the mandrel at both ends of the passage, the mandrel having two ports communicating each of said annular chambers with the mandrel bore and an intermediate port venting said passage, the piston in the actuate position connecting one chamber with the passage and the other chamber with the piston bore beyond the seals, and vice-versa in said de-actuate position.

7. A tool according to claim 1, wherein the mandrel bore and piston are stepped, the annular piston chamber formed by said step between them being vented so that pressure of drilling mud in the body moves the piston along the mandrel to close said piston chamber.

8. A tool according to claim 1, wherein the piston and mandrel between them define a barrel cam so that the piston rotates on axial movement thereof relative to the mandrel, the cam permitting different strokes of the piston in dependence upon the angular position of the piston in the mandrel.

9. A tool according to claim 8, wherein the piston and mandrel have inter-digitating castellations which, when they oppose one another in a first angular position of the piston with respect to the mandrel, as determined by the barrel cam, permit the piston to move to one of said actuate and de-actuate positions and, when they inter-digitate, permit the piston to move to the other of said actuate and de-actuate positions.

10. A tool according to claim 9, wherein the barrel cam comprises a pin in a track and the track is arranged so that rotation of the piston with respect to the mandrel is complete before the castellations engage one another.

11. A tool according to claim 10, wherein the track is on the piston and the pin is on the mandrel.

12. A tool according to claim 10, wherein the track is so arranged that the castellations abut in either the actuate or de-actuate positions and transmit axial hydraulic forces between the piston and mandrel before the pin reaches the end of the track.

13. A tool according to claim 5, wherein the return step is inward of the body and comprises two rings interconnected and captivating between them ring sectors received in an annular groove in the body.

14. A tool according to claim 6, wherein the return step is inward of the body and comprises two rings interconnected and captivating between them ring sectors received in an annular groove in the body and wherein a passage through the return step is vented and communicates with said intermediate port of the mandrel, the mandrel being sealed to the return step on either side of said passage and intermediate port.

15. A tool according to claim 5, wherein the diameter of the chambers are different, the chamber serving to actuate the tool when pressurised having the larger diameter.

16. A tool according to claim 5, wherein the diameter of the mandrel in the body on the sides of the chambers remote from the return step is larger on the side where hydraulic pressure moves the mandrel to actuate the tool.

17. A tool according to claim 1, wherein a choke is activated when the tool is actuated, such activation to change the pressure drop of the drilling mud across the tool so as to signal the states of actuation of the tool.

18. A tool according to claim 17, wherein the piston carries a piston restrictor plate across the piston bore in face to face contact with a mandrel restrictor plate, the restrictor plates being angularly fixed with respect to the piston and mandrel respectively and restricting mud flow through the tool in dependence upon their relative angular position.

19. A tool according to claim 18, wherein the mandrel restrictor plate is angularly fixed with respect to the body, the body being angularly fixed with respect of the mandrel.

20. A tool according to claim 18, wherein the restrictor plates have a central aperture in register with one another and alternating sector spaces and sector lobes so that, when the lobes on the piston and mandrel plates are in register with one another, mud flows through both the central aperture and spaces, and when the lobes and spaces are in register, mud flows through the central aperture.

21. A tool according to claim 1, wherein said mandrel is moved to actuate the tool by hydraulic pressure of said drilling mud when said valve permits bleeding of a bleed chamber.

22. A tool according to claim 21, wherein said mandrel is moved to de-actuate the tool, on release of said hydraulic pressure, by a mandrel return spring.

23. A tool according to claim 21, wherein said bleed chamber is formed by a step between the mandrel and body.

24. A tool according to claim 1, wherein said mandrel is moved to actuate the tool by hydraulic pressure of said drilling mud when said valve permits bleeding of a bleed chamber and wherein said bleed chamber is formed by a step between the mandrel and body and wherein said piston serves to open and close a port between said bleed chamber and the body bore.

25. A tool according to claim 3 wherein said mandrel is moved to actuate the tool by hydraulic pressure of said drilling mud when said valve permits bleeding of a bleed chamber, wherein said bleed chamber is formed by a step between the mandrel and body, wherein said piston serves to open and close a port between said bleed chamber and the body bore and wherein said piston, when it moves from said low-pressure position to said pressure position, only opens said port when it moves to said actuate position.

26. A tool according to claim 17, wherein said mandrel is moved to actuate the tool by hydraulic pressure of said drilling mud when said valve permits bleeding of a bleed chamber, wherein said bleed chamber is formed by a step between the mandrel and body, wherein said piston serves to open and close a port between said bleed chamber and the body bore and wherein said body defines, with the ends of said piston and mandrel, a valve chamber, said choke comprising a path between said piston and body which is opened when said piston moves to said actuate position and the mandrel moves to actuate the tool, and which is restricted when the piston moves to said de-actuate position.

27. A stabiliser comprising a tool according to claim 1, and further comprising members radially disposed in the body and pressed outwardly by the mandrel during actuation of the tool to increase the effective diameter of the stabiliser.

28. A drill string comprising a drill bit, and a near-bit stabiliser comprising a stabiliser according to claim 27.

* * * * *

UNITED STATES PATENT AND TRADEMARK OFFICE

CERTIFICATE OF CORRECTION

PATENT NO. : 7,128,170 B1
APPLICATION NO. : 10/441672
DATED : October 31, 2006
INVENTOR(S) : Mark Alexander Russell et al.

It is certified that error appears in the above-identified patent and that said Letters Patent is hereby corrected as shown below:

On the patent face under the section entitled Prior Publication Data, please add the following:

--(63) Related U.S. Application Data

Continuation of application No. PCT/GB01/05057, filed on Nov. 15, 2001.--

In column 1, line 7 please correct "claims the benefit of" to read --is a continuation of--

Signed and Sealed this
Twenty-fourth Day of January, 2012

David J. Kappos

David J. Kappos
*Director of the United States Patent and Trademark Office*